United States Patent [19]

Kaimai et al.

[11] Patent Number: 4,707,280

[45] Date of Patent: Nov. 17, 1987

[54] LUBRICATING OIL FOR USE IN FLON ATMOSPHERE

[75] Inventors: Takashi Kaimai, Saitama; Sampo Kusayanagi, Kanagawa, both of Japan

[73] Assignee: Nippon Mining Co., Ltd., Tokyo, Japan

[21] Appl. No.: 864,990

[22] Filed: May 20, 1986

[30] Foreign Application Priority Data

May 20, 1985 [JP] Japan ..... 60-105956

[51] Int. Cl.[4] ..... C10M 155/02

[52] U.S. Cl. ..... 252/49.6; 252/49.7; 252/56 R

[58] Field of Search ..... 252/49.7, 49.6

[56] References Cited

U.S. PATENT DOCUMENTS

| | | | |
|---|---|---|---|
| 3,047,499 | 7/1962 | Monterey | 252/49.6 |
| 3,058,912 | 10/1962 | Antler | 252/49.7 |
| 3,143,524 | 8/1964 | Cooper et al. | 252/49.6 |
| 3,177,178 | 4/1965 | Bluestein | 252/49.6 |
| 3,290,248 | 12/1966 | Michael | 252/49.6 |
| 3,560,542 | 2/1971 | Kim et al. | 252/49.6 |
| 4,356,098 | 10/1982 | Chagnon | 252/49.6 |

*Primary Examiner*—William R. Dixon, Jr.
*Assistant Examiner*—E. McAvoy
*Attorney, Agent, or Firm*—Sughrue, Mion, Zinn, Macpeak, and Seas

[57] ABSTRACT

A lubricating oil composition for use in a Flon atmosphere is disclosed, which comprises a base oil having incorporated therein from 20 to 10,000 wt ppm of a higher fatty acid-modified silicone oil. The lubricating oil composition is excellent in both wear resistance and Flon stability.

3 Claims, No Drawings

LUBRICATING OIL FOR USE IN FLON ATMOSPHERE

FIELD OF THE INVENTION

This invention relates to a lubricating oil to be used in a Flon atmosphere and, more particularly, to a lubricating oil composition suitable for use in refrigerators, and particularly for use in rotary compressors.

BACKGROUND OF THE INVENTION

With recent demands for small-sized refrigeration compressors with larger outputs for compressing Flon refrigerants that are used in air-conditioners, refrigerators, and the like, rotary compressors have been widely employed in replacement of conventional reciprocating compressors.

The rotary compressors have a high contact pressure and a high sliding speed in the sliding portion and also meet with a high discharge temperature. Therefore, lubricating oils to be applied are required to have excellent Flon stability, high wear resistance and assured extreme pressure resistance.

In order to improve wear resistance of lubricating oils, phosphoric esters, e.g., tricresyl phosphate and triphenyl phosphate, have hitherto been used as extreme pressure additives. However, results of evaluation of the lubricating oils containing these phosphoric esters through application to actual compressors revealed unfavorable phenomena that the wear of the sliding parts is rather promoted and that copper plating is promoted. It was confirmed that the wear is resulted from corrosion with hydrochloric acid which is a decomposition product of Flon and the decomposition of Flon is markedly accelerated in the presence of the phosphoric esters.

Further, Japanese Patent Application (OPI) No. 71464/76 (the term "OPI" herein used means "unexamined published application") discloses that refrigerating machine oils comprising long-chain alkylbenzenes as a base oil having incorporated therein dimethyl polysiloxane are excellent in heat stability. These oils, however, do not serve the purpose of improving wear resistance.

SUMMARY OF THE INVENTION

In the light of these circumstances, an object of this invention is to provide a lubricating oil for use in a Flon atmosphere, which exhibits both excellent wear resistance and Flon stability.

Flon atmosphere refers to a Flon compound-containing atmosphere. The term "Flon" as used herein is a generic term for halogen substituted compounds containing fluorinated methane or ethane hydrocarbons and having a chemical structure represented by the formula: $C_kH_lCl_mF_n$ (wherein k is an integer of 1 or 2, and $2k+2=l+m+n$). Illustrative Flons are products sold under the trademark "Freon" from Du Pont such as Freon-11 (F-11), Freon-12 (F-12), Freon-13 (F-13), Freon-21 (F-21), Freon-22 (F-22), Freon-113 (F-113), Freon-114 (F-114), Freon-115 (F-115) and Freon-502 (F-502), and equivalents thereof. The Flon R-12 or Flon R-22, for example, is equivalent to Freon F-12 or Freon F-22, respectively, in the chemical composition and properties.

As a result of extensive investigations to solve the above-described problems without adversely affecting Flon stability and a copper plating phenomenon, it has now been found that a certain kind of dimethyl polysiloxane derivatives produces an effective activity on lubricating oils.

The present invention relates to a lubricating oil composition comprising a lubricating base oil having incorporated therein from 20 to 10,000 wt ppm of a higher fatty acid-modified silicone oil.

DETAILED DESCRIPTION OF THE INVENTION

The base oil which can be used in this invention is not particularly limited, and includes generally employed mineral oils or synthetic oils having a viscosity of from about 5 to about 500 cSt ($mm^2$/sec) at 40° C. and mixtures thereof. The mineral oils to be used include raffinates of fractions having the above-described viscosity range obtained from naphthene or paraffin crude oils. The viscosity may appropriately be selected depending on purposes. Since it is particularly important to use a base oil having a low pour point, the base oil is preferably refined by low-temperature dewaxing or hydrogenation dewaxing. The synthetic oils to be used include heavy alkylates, i.e., long-chain alkylbenzenes, poly-α-olefins, polybutene, etc.

The higher fatty acid-modified silicone oil which can be used in the present invention is a dimethyl polysiloxane whose methyl groups are partially replaced with a saturated higher fatty acid having from 12 to 18 carbon atoms, such as lauric acid, myristic acid, palmitic acid, stearic acid, etc., and can be represented by the formula:

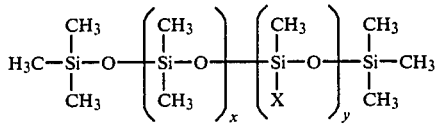

wherein X represents a group of ($CH_2$—$_n$COOH; n represents an integer of from 11 to 17; and the sum of x and y is from 10 to 1,000 with an x/y ratio of from 100/1 to 1/100.

Specific examples of the higher fatty acid-modified silicone oil represented by the above formula include KF 910, X-22-800 (trade names both produced by Shin-etsu Chemical Industry Co., Ltd.) and analogous thereof. Of fatty acid-modified silicone oils, those wherein the modifying fatty acid is an unsaturated fatty acid have reduced Flon stability, and those wherein the modifying substituent is a lower fatty acid having not more than 10 carbon atoms do not bring about any effect to improve wear resistance.

The above-described higher fatty acid-modified silicone oil is added to the base oil in an amount of from 20 to 10,000 wt ppm, and preferably from 70 to 3,000 wt ppm. If the amount is less than 20 wt ppm, sufficient wear resistance cannot be exerted. The higher fatty acid-modified silicone oil of the present invention is not so highly soluble in the base oil at low temperatures, and the upper limit of solubility is about 10,000 wt ppm, though varying depending on the properties of the base oil. As the amount of the higher fatty acid-modified silicone oil in the lubricating oil composition increases, the wear resistance of the composition is heightened.

The effect of improving wear resistance as obtained by the present invention cannot be exerted with modified silicone oils other than the higher fatty acid-modified silicone oils according to the present invention, such as epoxy-modified silicone oil, carboxy-modified silicone oil, mercapto-modified silicone oil, etc., or with general silicone oils.

The lubricating oil composition containing the higher fatty acid-modified silicone oil of this invention, when in use under a Flon atmosphere, exhibits excellent wear resistance and extreme pressure resistance without impairing Flon stability. Moreover, it is effective to improve hue stability and to prevent rust on iron or copper.

The lubricating oil composition of the invention may further contain other additives commonly employed, such as defoaming agents, e.g., dimethyl polysiloxanes, antioxidants, e.g., dibutyl-p-cresol, and hydrochloric acid-scavengers.

This invention will now be illustrated in greater detail with reference to the following examples, but it should be understood that they are not intended to limit the present invention.

EXAMPLE

Lubricating oils were prepared by mixing a paraffin mineral oil having a viscosity of 32 cSt ($mm^2$/sec) (40° C.), a naphthene mineral oil having a viscosity of 30 cSt ($mm^2$/sec) (40° C.) and a mixed oil of an alkylbenzene (Zeflon 150) and a paraffin mineral oil having a viscosity of 32 cSt ($mm^2$/sec) as a mixture with a higher fatty acid-modified silicone oil (KF 910, produced by Shin-etsu Chemical Industry Co., Ltd.) as shown in Table 1.

Each of the resulting lubricating oils was evaluated for performances as follows:

Performance Test Method:

A rotating shaft was held by two V blocks and rotated at 290 rpm by means of a Falex testing machine specified by ASTM-D-2670. Load resistance was evaluated by determining a load at which seizing of a test piece occurred. Wear resistance was evaluated by measuring an amount of wear of the test piece after running for 1 hour under a load fixed at 300 lb. The testing was carried out in an atmosphere of Flon R-12.

Flon stability was evaluated by charging iron, copper, aluminum wire (catalyst), a test oil and Flon R-12 in a sealed glass tube and, after preserving for a given period of time, measuring the hue of the oil and the amount of hydrochloric acid generated.

The results obtained are shown in Tables 1 to 3 below.

TABLE 1

| Sample No. | Base Oil | Amount of KF 910 Added (ppm) | Seizing in Falex test Load (lb) |
|---|---|---|---|
| 1 | paraffin mineral oil | not added | 500 |
| 2 | paraffin mineral oil | 50 | 750 |
| 3 | paraffin mineral oil | 300 | 1,100 |
| 4 | paraffin mineral oil | 1,000 | 1,500 |
| 5 | naphthene mineral oil | not added | 510 |
| 6 | naphthene mineral oil | 30 | 1,050 |
| 7 | mixture of alkylbenzene and paraffin mineral oil | not added | 480 |
| 8 | mixture of alkylbenzene and paraffin mineral oil | 300 | 1,050 |

TABLE 2

| Base Oil | Amount of KF 910 Added (ppm) | Amount of Wear (mg) |
|---|---|---|
| paraffin | not added | 37.9 |
| mineral oil paraffin mineral oil | 300 | 9.1 |
| naphthene mineral oil | not added | 36.2 |
| naphthene mineral oil | 300 | 6.9 |

TABLE 3

| Base Oil | Additive | Hue (ASTM) After 240 Hrs | Hue (ASTM) After 480 Hrs | Amount of HCl Generated After 480 Hrs (mg) |
|---|---|---|---|---|
| paraffin mineral oil | not added | L2.0 | L3.0 | 18 |
| paraffin mineral oil | tricresyl phosphate | L3.5 | L7.0 | 51 |
| paraffin mineral oil | higher fatty acid-modified silicone oil | L2.0 | L3.0 | 16 |

As is obvious from Table 1, the lubricating oil containing the higher fatty acid-modified silicone oil of the present invention has excellent load resistance. Table 2 reveals the remarkable improvement in wear resistance brought about by the lubricating oil of the present invention. Further, as is shown in Table 3, the silicone oil of the present invention does not adversely affect Flon stability at all, while the lubricating oil containing tricresyl phosphate adversely influences Flon stability.

COMPARATIVE EXAMPLE

To the same paraffin mineral oil as used in Example was added 300 ppm of dimethyl polysiloxane, epoxy-modified silicone oil (KF 102, produced by Shin-etsu Chemical Industry Co., Ltd.) or carboxy-modified silicone oil (X-22-3710, produced by Shin-etsu Chemical Industry Co., Ltd.). Each of the resulting oil compositions was subjected to performance test using a Falex testing machine in the same manner as described in Example to determine anti-seizing property and wear of a test piece. The results obtained are shown in Table 4 below.

Since the oil to which dimethyl polysiloxane had been added caused muddiness, the determination of anti-seizing property and wear was not carried out.

TABLE 4

| Additive | Seizing Load (lb) | Amount of Wear (mg) |
|---|---|---|
| not added | 500 | 37.9 |
| epoxy-modified silicone oil | 480 | 38.4 |
| carboxy-modified silicone oil | 490 | 36.2 |

It can be seen from Table 4 that addition of silicone oils other than the higher fatty acid-modified silicone oil according to the present invention does not make any contribution to improvement of load resistance.

While the invention has been described in detail and with reference to specific embodiments thereof, it will be apparent to one skilled in the art that various changes and modifications can be made therein without departing from the spirit and scope thereof.

What is claimed is:

1. A lubricating oil composition comprising a base oil having incorporated therein from 20 to 10,000 wt ppm of a methylpolysiloxane whose methyl groups are partially replaced with a higher fatty acid having from 12 to 18 carbon atoms.

2. A lubricating oil composition as in claim 1, wherein said higher fatty acid-modified silicone oil is represented by the formula:

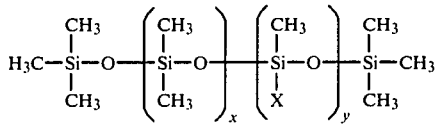

wherein X represents a group of $-(CH_2)_nCOOH$; n represents an integer of from 11 to 17; and the sum of x and y is from 10 to 1,000 with an x/y ratio of from 100/1 to 1/100.

3. A lubricating oil composition as in claim 1, wherein said higher fatty acid-modified silicone oil is present in an amount of from 70 to 3,000 wt ppm.

* * * * *